United States Patent [19]

Weston

[11] Patent Number: 4,477,936

[45] Date of Patent: Oct. 23, 1984

[54] MULTIPURPOSE BICYCLE TOOL

[76] Inventor: Jerome L. Weston, 3134 Eastern Pkwy., Baldwin, N.Y. 11510

[21] Appl. No.: 457,932

[22] Filed: Jan. 14, 1983

[51] Int. Cl.[3] ..... B25F 1/00; B25B 13/10

[52] U.S. Cl. ..... 7/139; 7/100; 7/165

[58] Field of Search ..... 7/138, 139, 165, 100; 81/DIG. 7, 121 B

[56] References Cited

U.S. PATENT DOCUMENTS

| | | | |
|---|---|---|---|
| 597,286 | 1/1898 | Horswill, Jr. | 7/138 |
| 1,335,092 | 3/1920 | Conley | 81/DIG. 7 |
| 1,454,320 | 5/1923 | Jenkins | 81/121 B |
| 1,581,119 | 4/1926 | Herring | 7/138 |

FOREIGN PATENT DOCUMENTS

| | | | |
|---|---|---|---|
| 879366 | 6/1953 | Fed. Rep. of Germany | 7/100 |
| 103569 | 1/1942 | Sweden | 7/139 |
| 12484 | of 1904 | United Kingdom | 7/139 |

*Primary Examiner*—Roscoe V. Parker

*Attorney, Agent, or Firm*—Gottlieb, Rackman & Reisman

[57] ABSTRACT

There is disclosed a multipurpose bicycle tool which provides a wrench for adjustment of brakes, spokes and hardware attachments of a bicycle frame, a tire iron for dislodging a tire from the rim of a wheel, and a screwdriver. The bicycle tool includes an elongated handle member configured for employment as a tire iron, and a wrench oriented in a plane angularly offset from the plane of the handle. The tool also includes a pair of perpendicularly oriented screwdriving blades which extend from the wrench. In applications of the bicycle tool as a wrench for adjustment of hardware components of the bicycle, and as a spoke wrench, the angular offset arrangement of the handle member and wrench permit unobstructed movement of the handle member relative to the bicycle frame and spokes for continuous rotation.

5 Claims, 13 Drawing Figures

FIG. 1
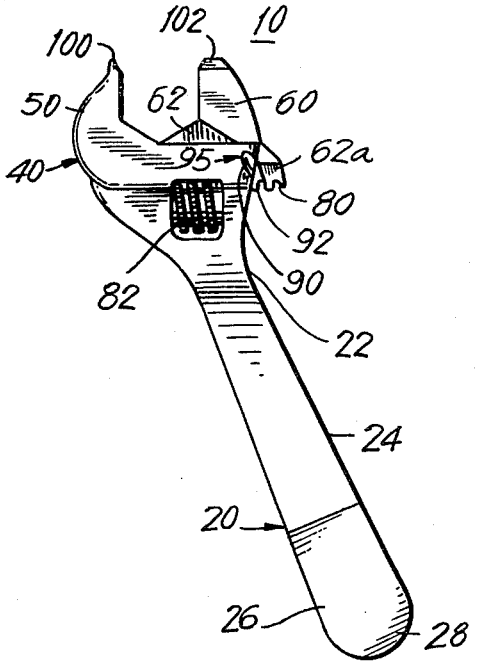
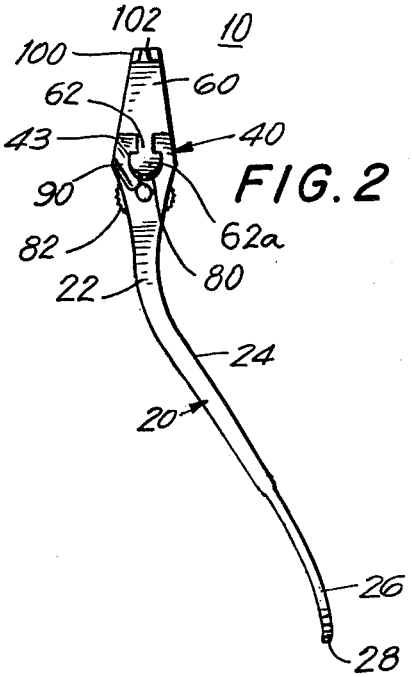
FIG. 2
FIG. 3
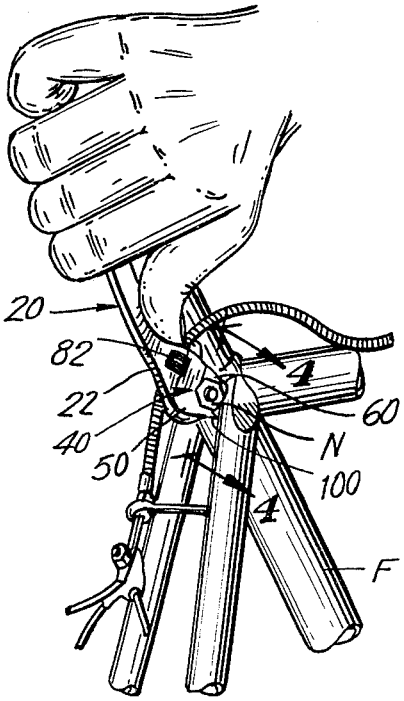
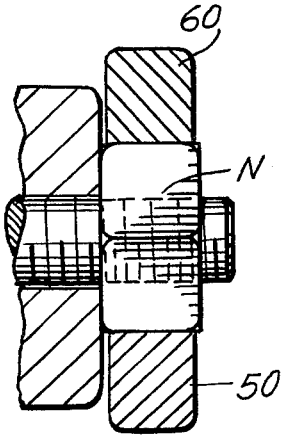
FIG. 4

FIG. 9
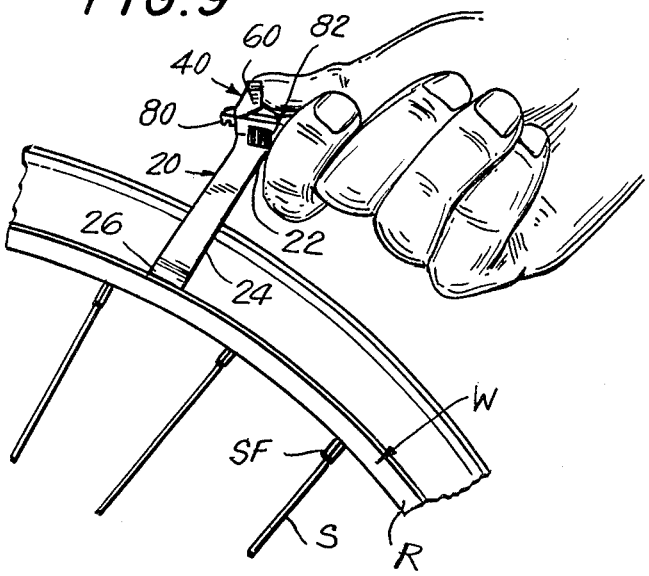
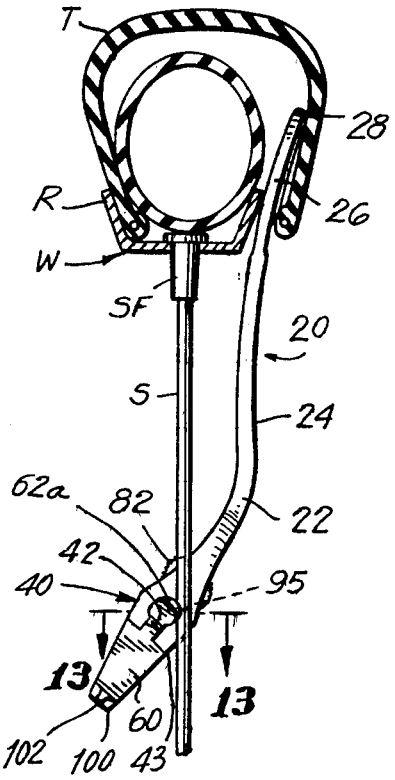
FIG. 12
FIG. 10
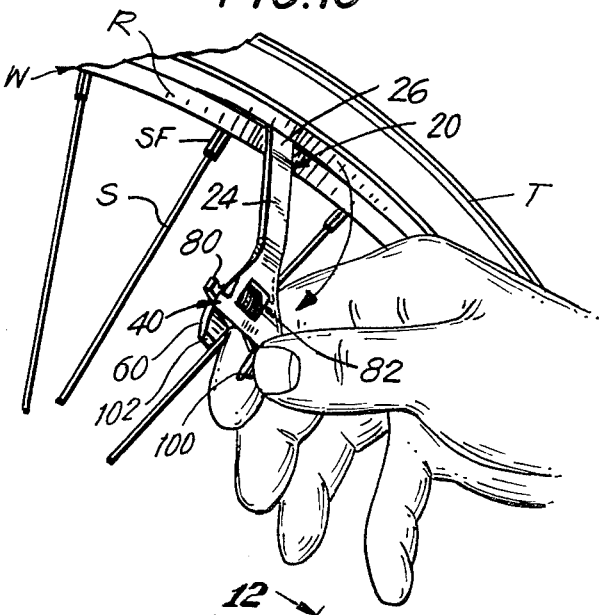
FIG. 13
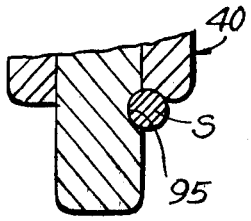
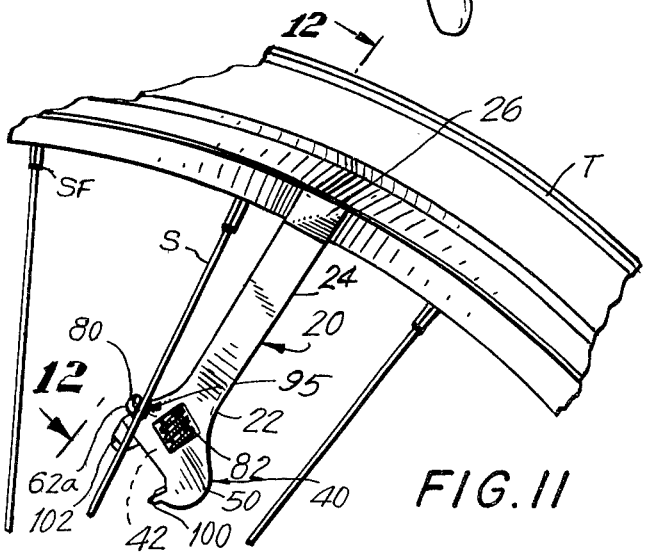
FIG. 11

MULTIPURPOSE BICYCLE TOOL

DESCRIPTION

1. Technical Field

This invention relates to a multipurpose tool specifically designed for use by cyclists in the repair and adjustment of a bicycle where conventional tools are not readily available. More particularly, it is concerned with a multipurpose bicycle tool providing a wrench for adjustment of brakes, spokes and hardware attachments of a bicycle frame, a tire iron for dislodging a tire from the rim of a wheel, and a screwdriver. The bicycle tool permits a cyclist to effect bicycle repairs and adjustments quickly and efficiently in an arrangement of uncomplex design having the capability to effect precise tolerance adjustments.

2. Background Art

When riding a bicycle, a cyclist must be prepared to perform minor repairs and adjustments to the bicycle while on the road. By way of example, a cyclist often requires the use of a spoke wrench for spoke adjustments, a tire iron for removal of a tire from a wheel, and a wrench for adjustment of brakes and hardware attachments of the bicycle frame. Heretofore, the prior art has provided cyclists with tool kits and accessories which may be readily dismantled and assembled for convenience in carriage on the bicycle. The art has also provided panniers including pockets and compartments for carriage of tool kits, as well as handle bar and frame carrying bags for carriage and storage of bicycling tools and gear.

However, in general, there has not been available a multipurpose tool of uncomplex design and lightweight construction having design features permitting its application for use in effecting precision bicycle adjustments and repairs. It will be appreciated that difficulties are presented by the need of the cyclist to carry conventional wrenches, tire irons and screwdrivers because of the weight and space which such tools occupy. For example, when touring, it is most desirable to carry an absolute minimum of supplies and accessories to permit the cyclist to lessen the burden of distance bicycle tours. In this connection, it will also be appreciated that available carrier space provided by panniers and other carrying bags is limited and that the need to carry conventional tools limits available space.

Accordingly, it is the broad object of the present invention to provide a multipurpose tool specifically designed for cyclists having application in the performance of general bicycle repairs.

A more specific object of the present invention is to provide a multipurpose bicycle tool having design features permitting its application as a tire iron, a wrench for adjustment of brakes and hardware attachments of a bicycle frame, as well as bicycle spokes, and a screwdriver for adjustment of a bicycle derailer and other screw operable components of a bicycle.

A still further object of the invention is to provide a multipurpose bicycle tool having improved operational advantages by provision of a tool of uncomplex design which accommodates precise tolerance bicycle adjustments and which is of lightweight construction and compact design for placement in carrying bags or in the cyclist's pocket.

These and other objects of the present invention are obtained by providing a multipurpose tool, particularly useful in applications for repair of bicycles, which includes an elongated handle member configured to act as a tire iron, and an integral wrench means whose orientation is angularly offset relative to the plane of the handle member. The multipurpose bicycle tool also includes a screwdriving means integral with the wrench means which is provided in the form of spaced screwdriving blades. In order to facilitate employment of the bicycle tool as a tire iron, the handle member is provided with an end portion having a reduced cross-sectional thickness. A groove positioned in the wrench means is provided to secure the bicycle tool to a bicycle spoke when in use as a tire iron. In applications of the multipurpose tool as a wrench, the angularly offset arrangement of the handle member and wrench means provides advantages by permitting unobstructed movement of the handle member relative to the bicycle frame.

According to the preferred embodiment of the invention, the wrench means is provided in the form of an adjustable open ended wrench having a fixed jaw member, a movable jaw member, and a worm gear arrangement for positioning the movable jaw member. The adjustability feature of the open end wrench permits application of the multipurpose tool for effecting required adjustments of brakes and hardware attachments of the bicycle frame, as well as application of the bicycle tool as a spoke wrench. In the preferred embodiment of the invention, the screwdriving means includes a pair of spaced screwdriving blades which extend from the wrench jaw members.

Other objects, features and advantages of the present invention will be apparent when the detailed description of the preferred embodiment of the invention is considered in conjunction with the drawings, which should be construed in an illustrative and not limiting sense, as follows:

BRIEF DESCRIPTION OF DRAWINGS

FIG. 1 is a plan elevational view of an illustrative embodiment of the multipurpose bicycle tool of the present invention including an outwardly oriented handle, adjustable wrench, tire iron and screwdriver features;

FIG. 2 is a side elevational view of the multipurpose bicycle tool;

FIG. 3 illustrates the multipurpose bicycle tool employed as a wrench for adjustment of an internally-threaded nut on a bicycle frame;

FIG. 4 is a cross-sectional view of the multipurpose bicycle tool taken substantially along the line 4—4 of FIG. 3;

FIG. 9 shows the multipurpose bicycle tool employed as a tire iron illustrating the manner in which an end portion of the handle member is wedged between the bicycle tire and rim to effect their separation;

FIG. 10 shows the multipurpose bicycle tool of FIG. 9 rotated outwardly in overlying relation with respect to the rim to separate the tire and rim;

FIG. 11 shows the multipurpose bicycle tool of FIG. 10 secured adjacent a bicycle spoke by a spoke securing groove in the wrench portion of the tool;

FIG. 12 is a cross-sectional view of the bicycle tool and bicycle wheel taken substantially along the line 12—12 of FIG. 11; and FIG. 13 is a cross-sectional view, enlarged in scale, taken along the line 13—13 of FIG. 12.

BEST MODE FOR CARRYING OUT THE INVENTION

Figure 5:
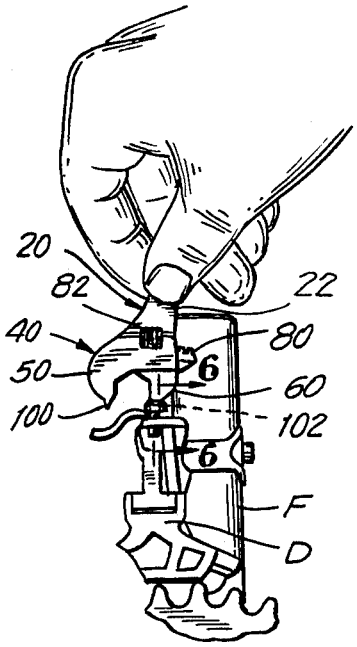
FIG. 5 illustrates the multipurpose bicycle tool employed as a screwdriver for adjustment of bicycle gears and derailer.

Referring now to the drawings and, more particularly, to FIGS. 1 and 2 thereof, there is illustrated a multipurpose bicycle tool according to the present invention, generally designated 10, comprising two components, an elongated handle member 20 which provides the tire iron features of the invention and an integral wrench means which incorporates adjustable wrench and screwdriver tool features. The multipurpose bicycle tool 10 is formed of a carbon steel having wear resistance and tensile strength characteristics which accommodate the specification requirements of conventional tools employed for general bicycle repairs. As an example of the foregoing, the material of the multipurpose bicycle tool 10 may be a C1030 carbon steel.

The handle member 20 of the multipurpose bicycle tool 10, shown best in FIGS. 1 and 2, includes an arcuate portion 22 which extends angularly in a direction out of the plane of the handle member 20, a middle portion 24 and an end portion 26 having a reduced cross-sectional thickness. The end portion 26 has a flared edge 28 bent slightly in a direction opposite to that of the bend of arcuate portion 22.

The wrench means of the multipurpose bicycle tool 10 extends integrally from the arcuate portion of the handle member 20 in angularly offset relation to the plane of the handle member. The wrench means, which is preferably provided in the form of an adjustable open ended wrench, includes a wrench body 40 having fixed jaw member 50 and movable jaw member 60.

To provide the adjustability feature of the wrench, the movable jaw member 60 is provided with a longitudinally extending sleeve 62 of reduced cross-sectional width which is dimensioned for slidable positioning in a slot 42 in wrench body 40. This permits arrangement of jaw members 50,60 in close spaced relation (FIG. 8) and spaced apart relation (FIG. 1).

A conventional worm gear means is provided for positioning the movable jaw member 60 at variable locations relative to the jaw member 50. The gear means includes a rack 80 which is formed within an enlarged cylindrical portion 62*a* of the jaw member sleeve 62, and a helical gear member 82 which is mounted in the wrench body 40.

A spoke securing means which coacts with the handle 20, in a manner which will be described below, enhances the tire iron feature of the multipurpose bicycle tool 10. The spoke securing means, illustrated in FIGS. 1, 12, and 13, includes an angular groove 90 disposed in a side edge 43 of the wrench body 40 and a corresponding groove 92 disposed in the enlarged cylindrical sleeve portion 62*a* of the movable jaw member 60. When the movable jaw member 60 is arranged in near maximum extension relative to the fixed jaw member 50, the enlarged cylindrical sleeve portion 62*a* extends outwardly of the wrench body 40 through slot 42 in the wrench body, as shown in FIG. 1. In this position the grooves 90, 92 are arranged in alignment to provide a single elongated spoke groove 95, as seen best in FIG. 13.

Figure 8:
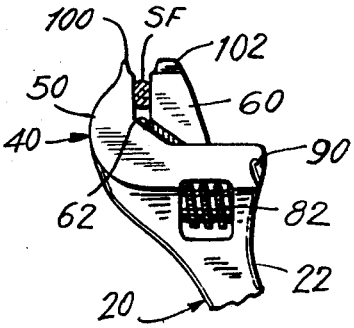
FIG. 8 is a cross-sectional view of the bicycle tool taken substantially along the line 8—8 of FIG. 7.

The multipurpose bicycle tool 10 also includes a screwdriving means, illustrated in FIGS. 1, 5, and 8, which includes a pair of screwdriving blades, namely, a transversely extending blade 100 and a longitudinally extending blade 102 which extend from edges of jaw members 50, 60.

Operation Of The Multipurpose Bicycle Tool

When employed as an adjustable wrench, the multipurpose bicycle tool 10 is arranged as shown in FIG. 3 with the handle member 20 disposed outwardly of the bicycle frame so that fixed and adjustable jaw members 50, 60 may engage a nut N or other bicycle frame F adjusting hardware. Outward arrangement of the handle member 20 with respect to the bicycle frame provides advantage by permitting unobstructed rotational movement of the multipurpose bicycle tool 10 relative to the bicycle frame. By way of example, in FIG. 3, it will be seen that the handle member 20 extends outwardly of the bicycle frame when the wrench is arranged in engagement with the nut N, thereby facilitating rotational movement of the tool in a continuous motion with the user's hand free of the bicycle frame.

Figure 7:
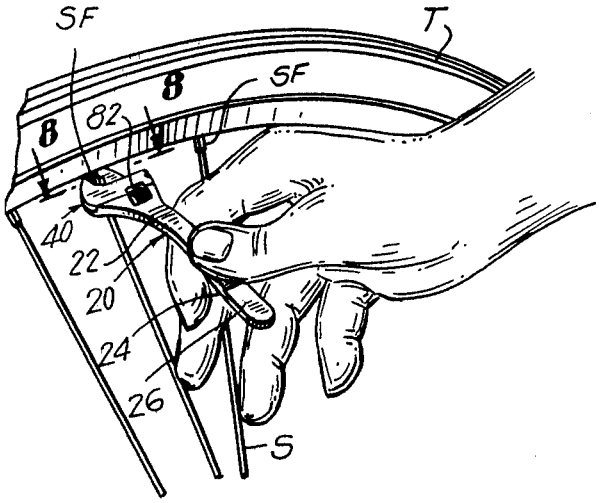
FIG. 7 illustrates the multipurpose bicycle tool employed as a spoke wrench showing the angularly disposed tool handle member oriented outwardly of a tire rim for unobstructed rotation thereof.

In a similar manner, the angular offset arrangement of the handle member 20 and wrench body 40 permits application of the multipurpose bicycle tool 10 for use as a spoke wrench, as seen best in FIG. 7. In this application of the multipurpose bicycle tool, the handle member 20 is positioned in generally parallel alignment with a spoke S with the wrench frame 40 disposed angularly inwardly and wrench jaws 50, 60 engaging a spoke fitting SF for adjustment. With this arrangement, the multipurpose bicycle tool 10 may be rotated in a continuous motion about spoke S passing without obstruction through the spaces between adjacent spokes.

With particular reference to FIGS. 9-13, it will be appreciated that the multipurpose bicycle tool 10 provides a tire iron for dislodging a tire T from a bicycle wheel W. In this application of the multipurpose tool, the end portion 24 of the handle member 20 is positioned between the wheel rim R and the tire T, as shown in FIG. 9, with flared edge 28 (see FIG. 12) disposed outwardly with respect to the tire. Arrangement of the handle 20 in this manner is facilitated by provision of the handle end portion 26 with a reduced cross-sectional thickness relative to the middle portion 24. It will be appreciated that the configuration of the end portion 26 also avoids undue abrasive contact of the handle member 20 with the tire and the wheel rim and associated deformation of the wheel rim and damage to the tire. To effect separation of the tire and the wheel rim, the multipurpose bicycle tool is rotated outwardly about the wheel rim as shown in FIG. 10. For this purpose, the wrench body 40 and extending jaw members 50, 60 provide an accessible handle for leveraging the bicycle tool 10 as it is rotated about the wheel rim. As shown in FIG. 11, the wrench frame 20 is then secured behind a spoke S in the elongated spoke securing groove 95. In this arrangement, the cyclist's hands are free for removal of the tire T from the wheel rim R.

Figure 6:
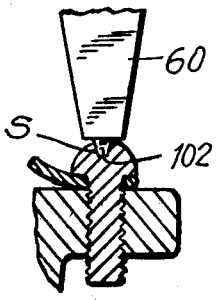
FIG. 6 is a vertical cross-sectional view taken along the line 6—6 of FIG. 5.

In FIGS. 5 and 6, the multipurpose bicycle tool 10 is shown in use as a screwdriver for adjustment of a fitting on the bicycle derailer D. In this application of the multipurpose bicycle tool, the handle member 20 is employed for driving the screwdriver blades 100, 102 to effect proper adjustment derailer screw S. For further efficiency in operation of the bicycle tool 10, the screwdriver blades 100, 102 are arranged in generally perpendicularly disposed planes. This provides advantage by permitting the user to efficiently position either of the screwdriving blades 100, 102 as required, to accommodate different angular orientations of a derailer screw or other hardware attachment of the bicycle frame.

From the foregoing, it will be appreciated that the present invention provides a multipurpose tool 10, particularly useful for repair of bicycles which overcomes the difficulties of the prior art and which achieves the objects stated heretofore. In particular, there is disclosed a multipurpose tool useful for general bicycle repairs which is compact and lightweight in design, and which may be readily carried in the cyclist's pocket or in a bicycle carrying bag.

Numerous modifications may be possible in light of the above teachings. For example, although the multipurpose bicycle tool is disclosed as incorporating an adjustable wrench, including fixed jaw member 50 and movable jaw member 60, the wrench means could be provided in the form of a non-adjustable box or open-ended wrench. Similarly, although the spoke securing means is disclosed as being provided in the form of a groove 95 positioned in side edge 43 of the wrench body 40 and enlarged cylindrical sleeve portion **62*a* of the movable jaw member 60, the securing groove 95 or other securing means may be positioned elsewhere in the wrench body 40**. It is to be understood, therefore, that the above-described embodiment of the invention is merely illustrative and that other embodiments may be devised by those skilled in the art, without departing from the spirit or scope of the present invention, as set forth in the appended claims.

I claim:

1. A multipurpose bicycle tool having, in combination, a tire iron for dislodging a tire from the rim of a wheel, and a wrench for adjustment of brakes and hardware attachments of a bicycle frame, said multipurpose bicycle tool comprising:

an elongated handle member including an arcuate portion, a middle portion and an end portion having a flared edge, said end portion being adapted for slidable insertion between the bicycle rim and the tire, so that rotation of the tool about the rim effects dislodgement of the tire from the rim;

a wrench extending from the arcuate portion of the handle member, said wrench being disposed in a direction which is angularly offset relative to the plane of the handle member, so that when the wrench is employed for adjustment of the brakes and hardware of the bicycle frame, the handle member is disposed outwardly of the bicycle frame, enabling unobstructed movement of the handle member relative to the bicycle frame; and tire iron securing means for securing the bicycle tool in fixed relation relative to the bicycle wheel when the bicycle tool is used as a tire iron, said securing means including a groove positioned in the wrench, the groove being adapted for securing the bicycle tool to a spoke of the wheel.

2. A multipurpose bicycle tool as set forth in claim 1, further comprising screwdriving means integral with said wrench, said screwdriving means including a pair of spaced screwdriving blades.

3. A multipurpose bicycle tool as set forth in claim 2, wherein the screwdriving blades are arranged in generally perpendicularly disposed planes.

4. A multipurpose bicycle tool having, in combination, a tire iron for dislodging a tire from the rim of a wheel, a wrench for adjustment of brakes and hardware attachments of a bicycle frame, and a screwdriver, said multipurpose bicycle tool comprising:

an elongated handle member having an arcuate portion, middle portion and an end portion, said end portion having a reduced cross-sectional thickness relative to the middle portion, and a flared edge for slidable insertion between the bicycle rim and the tire, so that rotation of the tool about the rim effects dislodgement of the rim and the tire;

a wrench for adjustment of the brake and hardware attachments of the bicycle frame extending from the arcuate portion of the handle member, said wrench being disposed in a direction which is angularly offset relative to the plane of the handle member so that when the wrench is employed for adjustment of the brakes and hardware of the bicycle frame, the handle is disposed outwardly of the bicycle frame enabling unobstructed movement of the handle member relative to the bicycle frame;

means for securing the bicycle tool in fixed relation relative to the bicycle wheel when the bicycle tool is used as a tire iron, said securing means including a groove positioned in the wrench, the groove being adapted for securing the bicycle tool to a spoke of the wheel; and a screwdriver integral with said wrench, said screwdriver integral with said wrench, said screwdriver including a pair of spaced screwdriving blades.

5. A multipurpose bicycle tool as set forth in claim 4, wherein said pair of screwdriving blades are arranged in generally perpendicularly disposed planes.

* * * * *